US009963281B2

(12) United States Patent
Bratsch

(10) Patent No.: US 9,963,281 B2
(45) Date of Patent: May 8, 2018

(54) CONTAINER LID WITH CLOSURE

(71) Applicant: XOLUTION GMBH, München (DE)

(72) Inventor: Christian Bratsch, Salzburg (AT)

(73) Assignee: Xolution GmbH, München (DE)

( * ) Notice: Subject to any disclaimer, the term of this patent is extended or adjusted under 35 U.S.C. 154(b) by 0 days. days.

(21) Appl. No.: 15/316,360

(22) PCT Filed: Jun. 5, 2015

(86) PCT No.: PCT/EP2015/062557
§ 371 (c)(1),
(2) Date: Dec. 5, 2016

(87) PCT Pub. No.: WO2015/185718
PCT Pub. Date: Dec. 10, 2015

(65) Prior Publication Data

US 2017/0152082 A1 Jun. 1, 2017

(30) Foreign Application Priority Data

Jun. 5, 2014 (EP) ..... 14171269

(51) Int. Cl.
*B65D 51/18* (2006.01)
*B65D 51/00* (2006.01)
(Continued)

(52) U.S. Cl.
CPC ..... *B65D 51/007* (2013.01); *B65D 43/18* (2013.01); *B65D 51/1672* (2013.01)

(58) Field of Classification Search
CPC ..... B65D 17/00; B65D 17/16; B65D 17/161; B65D 17/165; B65D 17/166; B65D 43/00;
(Continued)

(56) References Cited

U.S. PATENT DOCUMENTS 4,407,423 A 10/1983 Walter
8,844,744 B2 * 9/2014 Lucas ..... B65D 43/265 206/217
(Continued)

*Primary Examiner* — Steven A. Reynolds
*Assistant Examiner* — Javier A Pagan
(74) *Attorney, Agent, or Firm* — Dykema Gossett PLLC

(57) ABSTRACT

The invention relates to a lid for a container, in particular for a can, comprising: a lid surface (110) with a first opening (115) passing through the lid surface; an inner element (120), which is arranged on an inner side of the lid surface and has a ventilating opening (125), which passes through the inner element and is aligned with the first opening; an actuating element (130), which is arranged on an outer side of the lid surface and is formed preferably from plastics material, wherein the actuating element has a first (141) and a second (142) articulation region, said regions subdividing the actuating element into a first (131), a second (132) and a third (133) portion, and the second portion is arranged between the first and the third portions; wherein the first portion of the actuating element is arranged in abutment against the lid surface; the second portion of the actuating element can be pivoted relative to the first portion about the first articulation region and the second portion has a closing element, in particular a bung (135), for closing the ventilating opening; the third portion of the actuating element can be pivoted relative to the second portion about the second articulation region and the third portion has a first coupling element (161); and the inner element has a second coupling element (162), which can be coupled to the first coupling element.

15 Claims, 4 Drawing Sheets

(51) Int. Cl.
*B65D 51/16* (2006.01)
*B65D 43/18* (2006.01)

(58) Field of Classification Search
CPC ..... B65D 43/02; B65D 43/14; B65D 43/16; B65D 51/007
USPC ..... 220/253, 254.1, 254.2, 254.3
See application file for complete search history.

(56) References Cited

U.S. PATENT DOCUMENTS

| | | | | |
|---|---|---|---|---|
| 2007/0068943 | A1* | 3/2007 | Ramsey | B65D 17/506 220/254.3 |
| 2007/0262079 | A1 | 11/2007 | Paris et al. | |
| 2011/0006062 | A1* | 1/2011 | Bratsch | B65D 47/0866 220/265 |
| 2011/0315684 | A1 | 12/2011 | Bratsch | |
| 2013/0320013 | A1 | 12/2013 | Bratsch | |
| 2014/0332548 | A1* | 11/2014 | Bratsch | B65D 17/506 220/796 |
| 2015/0216340 | A1 | 8/2015 | Bratsch et al. | |

* cited by examiner

CONTAINER LID WITH CLOSURE

FIELD OF THE INVENTION

The present invention refers to a lid for a container, in particular for a can, comprising: a lid surface with a first opening passing through the lid surface; an inner element, which is arranged on an inner side of the lid surface and has a ventilating opening; which passes through the inner element and is aligned with the first opening; and an actuating element, which is arranged on an outer side of the lid surface, and wherein a closing element is provided for closing the ventilating opening.

PRIOR ART

Lids for a container of the above-mentioned type are known from the prior art. The closing element in the form of a peg is here normally pressed with some effort into the ventilating opening and fixed for instance by a seal laterally pressing against the peg. A configuration of a closure for the ventilating opening with a peg is e.g. disclosed in EP 2711307. The ventilating openings according to the prior art have an appropriately small cross-section to remain safely closed even if e.g. a carbonated beverage is contained in the container and an internal pressure is thus prevailing. The internal pressure, however, may also be generated by heating a content of air contained in the container. However, if the ventilating opening is intended to have a rather large crass-section, for instance in order to allow insertion of a drinking straw, the pressure on the peg may be so great that it is pressed open, which is disadvantageous.

DESCRIPTION OF THE INVENTION

It is the object of the invention to overcome said drawback and to allow a reliable multiple closing of the ventilating opening.

This object is achieved by a lid for a container according to claim 1.

The lid according to the invention for a container, in particular for a can, comprises; a lid surface with a first opening passing through the lid surface; an inner element, which is arranged on an inner side of the lid surface and has a ventilating opening, which passes through the inner element and is aligned with the first opening; an actuating element, which is arranged on an outer side of the lid surface and is formed preferably from plastics material, wherein the actuating element has a first and a second articulation region, said regions subdividing the actuating element into a first, a second and a third portion, and the second portion is arranged between the first and the third portions; wherein the first portion of the actuating element is arranged in abutment against the lid surface; the second portion of the actuating element can be pivoted relative to the first portion about the first articulation region and the second portion has a closing element, in particular a pin, for closing the ventilating opening; the third portion of the actuating element can be pivoted relative to the second portion about the second articulation region and the third portion has a first coupling element; and the inner element has a second coupling element, which can be coupled to the first coupling element.

By provision of the first and second intercoupled coupling elements on the third portion and on the inner element, respectively, a connection is established between the third portion and the inner element.

The lid according to the invention can be developed such that the first and second coupling elements provide a retention force in the coupled state upon exertion of a pressure on the closing element, starting from an interior of the container, particularly a retention force perpendicular to the lid surface that prevents the closing element from being pushed out of the ventilating opening. This prevents a situation where for instance in the case of a pin as the closing element said pin is pushed out of the ventilating opening in the case of a pressure exerted on the pin from the inside of the container (e.g. by a carbonated beverage enclosed therein).

According to another development the first and the second coupling element may be configured to be complementary to and engageable with each other. A connection can thereby be established between the third portion and the inner element in a simple manner.

In another development the first coupling element may be configured as one or plural eyelets and the second coupling element as one or plural snap-in noses, or vice versa, wherein respective snap-in noses are engageable with respective eyelets. This constitutes a configuration of the coupling elements that can be easily implemented from a manufacturing point of view.

Another development consists in that the coupling between the first and second coupling element may be self-locking, particularly such that a compressive force on the closing element is transmitted to the first coupling element such that it acts against a decoupling direction of the coupling elements. This prevents a situation where the exertion of pressure from the inside of the container causes an unintended opening, i.e. pushing out of the closing element, for instance by bending of the actuating element and by associated decoupling of the coupling elements.

According to a further development the articulation regions may be configured to be straight, particularly parallel to one another.

According to another development the articulation regions are configured as regions of the actuating element with reduced material thickness, particularly as notches that are preferably provided at a side facing away from the lid surface. The articulation regions can thereby be implemented easily from a manufacturing point of view.

Another development consists in that in the second articulation region one or plural struts may be provided between the second and third portion, which, starting from a planar orientation of the second and third portion, allow pivotability into a first direction, particularly by way of compressibility or bendability of the struts, and aggravate pivotability into a second direction opposite to the first direction, particularly in that the force application is greater upon pivoting into the second direction in relation to the force application upon pivoting into the first direction. This has the advantage that in the opened state of the closure a bending of the third portion opposite to the unfolding direction is aggravated. In addition or as an alternative, a bending or compression of the struts may serve as tamper evidence to recognize an already opened and reclosed container.

The aforementioned development, in turn, can be developed further such that the first direction may be oriented away from the lid surface, particularly wherein the first direction is an unfolding direction of the third portion upon opening of the container. This prevents or at least aggravates an undesired folding-in of the third portion towards the lid surface.

According to another development the first and second coupling elements can be coupled with each other repeatedly one after the other and can be decoupled again and can thereby ensure reclosability of the ventilating opening. Hence, the ventilating opening can be opened and reclosed repeatedly, whereby particularly for instance an outgassing of $CO_2$ from a carbonated beverage in an already opened container is prevented.

According to another development a second opening may be provided in the lid surface, and a fluid connection can be established between the second opening and a container interior by folding away the inner element from the inner side of the lid surface. This second opening may for instance be a pour or drink opening. This second opening is sealed on the inner side of the lid surface by the inner element and can be released by folding away the inner element from the lid surface into the interior of the container, so that for instance the liquid in the container can be poured out.

The above-mentioned development, in turn, can be developed such that the first portion of the actuating element is connected to or contactable with the inner element, particularly allowing a sliding movement relative to each other, and the inner element can be folded away by shifting the first portion of the actuating element. A folding away of the inner element is thereby achieved in a feasible way by shifting the actuating element, particularly the first portion.

Alternatively, the lid may further comprise an inner slide element which is arranged on the inner side of the lid surface, wherein the first portion of the actuating element is connected to the inner slide element and a unit consisting of the first portion of the actuating element and the inner slide element is shiftable along the lid surface, wherein further the inner slide element is connected to or contactable with the inner element, particularly allowing a sliding movement relative to each other, and the inner element can be folded away by shifting the unit.

The two above-mentioned developments, in turn, can be developed such that a shifting of the first portion is only possible after an unfolding of the third portion and a subsequent unfolding of the second portion, especially since the first and second coupling elements are decoupled thereby and the closing element is subsequently removed from the ventilating opening and the first opening. This has the advantage that an unintended shifting is not possible when the ventilating opening is still closed.

The invention also provides a container, in particular a can, comprising: a basic body; and a lid according to the invention or one of its above-listed developments.

The said developments can be used individually or, as claimed, combined with one another in a suitable manner.

Further features and exemplary embodiments as well as advantages of the present invention shall be explained hereinafter in more detail with reference to the drawings. It goes without saying that the embodiments are not restricted to the scope of the present invention. It further goes without saying that some or all of the features described hereinafter can also be combined with one another in a different way.

DRAWINGS

EMBODIMENTS

Figure 1:
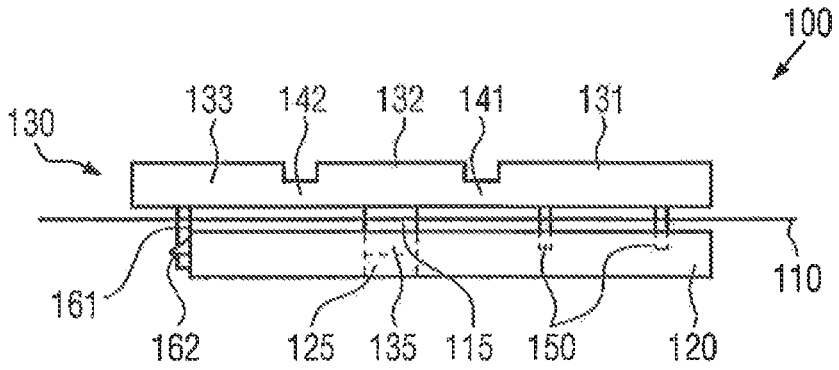
FIG. 1 shows a first embodiment of a lid according to the invention.

FIG. 1 schematically shows a first embodiment of a lid 100 according to the invention.

In this first embodiment, the lid 100 according to the invention comprises a lid surface 110 with a first opening 115 passing through the lid surface; an inner element 120 arranged on an inner side of the lid surface 110 with a ventilating opening (pressure equalization opening) 125 which passes through the inner element 120 and is aligned with the first opening 115; an actuating element 130 which is arranged on an outer side of the lid surface and which is for instance made from plastics material, wherein the actuating element 130 comprises a first articulation region 141 and a second articulation region 142 which subdivide the actuating element 130 into a first portion 131, a second portion 132 and a third portion 133, and the second portion 132 is arranged between the first portion 131 and the third portion 133, wherein the first portion 131 of the actuating element 130 is arranged in abutment against the lid surface 110; the second portion 132 of the actuating element 130 can be pivoted relative to the first portion 131 about the first articulation region 141, and the second portion 132 comprises a pin 135 for closing the ventilating opening 125; the third portion 133 of the actuating element 130 can be pivoted relative to the second portion 132 about the second articulation region 142, and the third portion 133 has a first coupling element 161; and the inner element 120 has a second coupling element 162, which can be coupled to the first coupling element 161.

The actuating element 130 is connected to the inner element 120 for instance by a riveting 150 of the first portion 131 by the lid surface 110 with the inner element 120. In this first embodiment of the lid 100, the first coupling element 161 is formed on the actuating element 130 exemplarily as an eyelet 161 and the second coupling element 162 is formed on the inner element 120 as a nose that can engage into the eyelet. When a force is exerted from the inside (in FIG. 1 below the lid surface 120) on the pin 135, the second portion 132 of the actuating element 130 can slightly bulge outwards. This has the consequence that the eyelet 161 is pressed onto the inner element 120 and the nose 162, i.e. in a direction opposite to the decoupling direction. The ventilating opening is therefore self-lockingly closed. For opening purposes the left-side end of the actuating element in FIG. 1 is gripped and lifted, whereby the coupling connection between eyelet 161 and nose 162 is uncoupled and a folding movement of the third portion 133 around the second articulation region 142 is carried out at the same time.

Figure 2A:
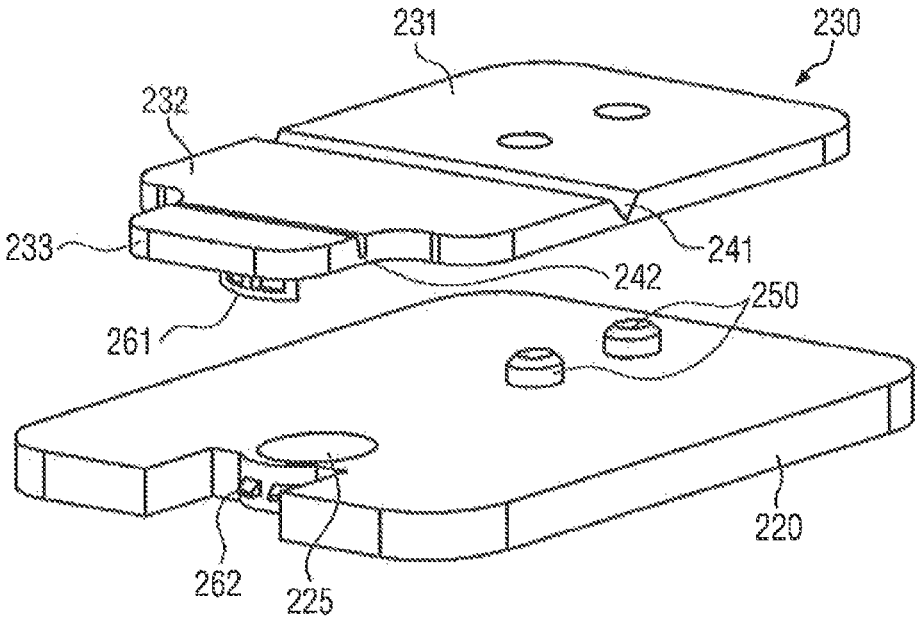
FIG. 2 shows a second embodiment of a lid according to the invention.
Figure 2B:
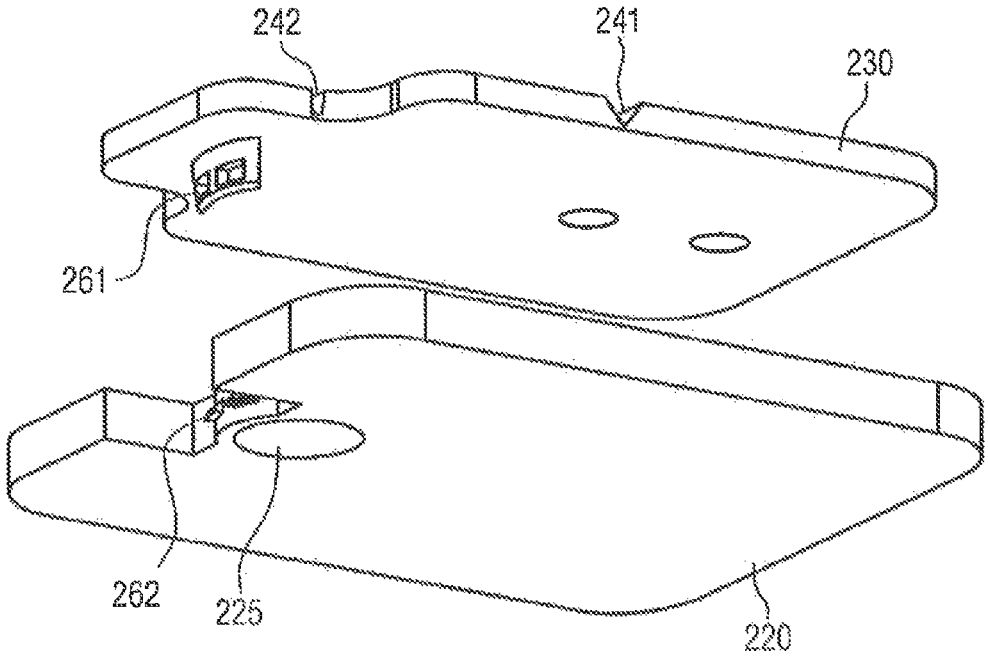

FIGS. 2A, B, C schematically show a second embodiment of a lid 200 according to the invention. The elements comparable to FIG. 1 are provided with a reference numeral increased by the number 100.

Figure 2C:
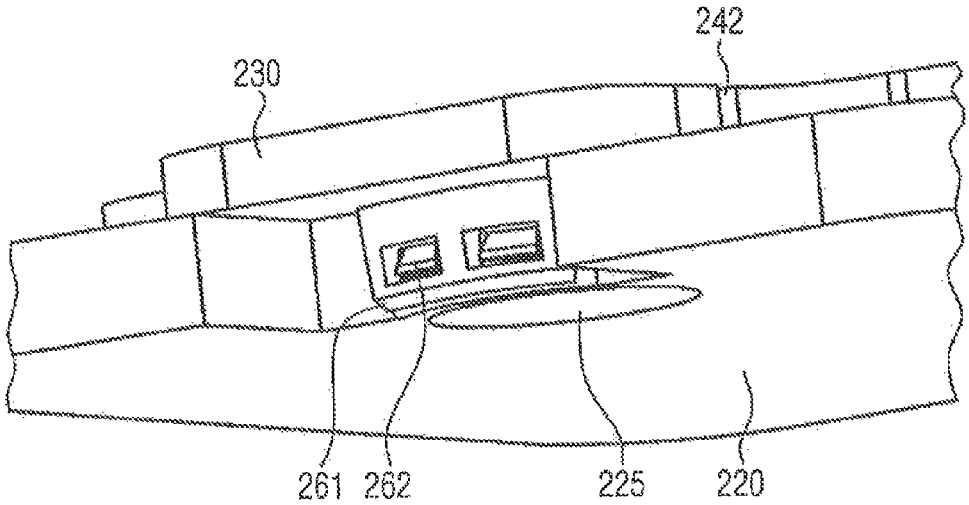

For the purpose of simplifying the illustration, the lid surface has here been omitted. In this embodiment the first coupling element comprises two eyelets 261 and the second coupling element comprises two locking noses 262. Each of FIGS. 2A, B, C shows a different perspective view, a closed state being illustrated in FIG. 2C.

Figure 3:
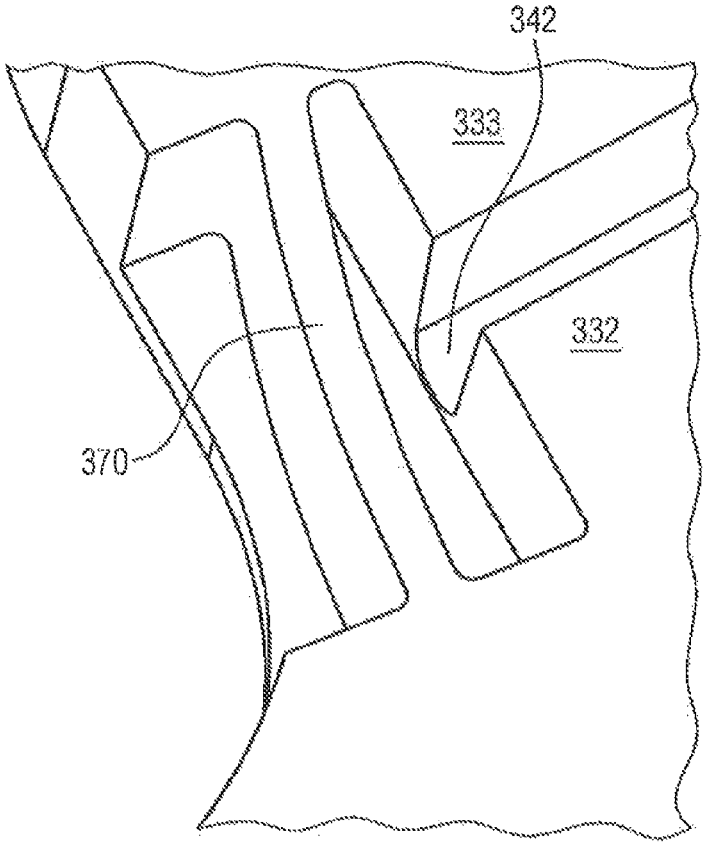
FIG. 3 shows a third embodiment of a lid according to the invention.

FIG. 3 shows a third embodiment. The elements comparable to FIG. 1 are provided with a reference numeral increased by the number 200.

In this embodiment, bridges 370 are provided (only one side is illustrated in FIG. 3) between the second portion 332 and the third portion 333. Said bridges 370 will buckle upon opening, thereby providing a tamper-evident feature as an already performed opening operation is thereby recognizable. Furthermore, the bridges 370 prevent a folding of the third portion 333 about the second articulation region 342 in the direction of the lid surface.

Figure 4:
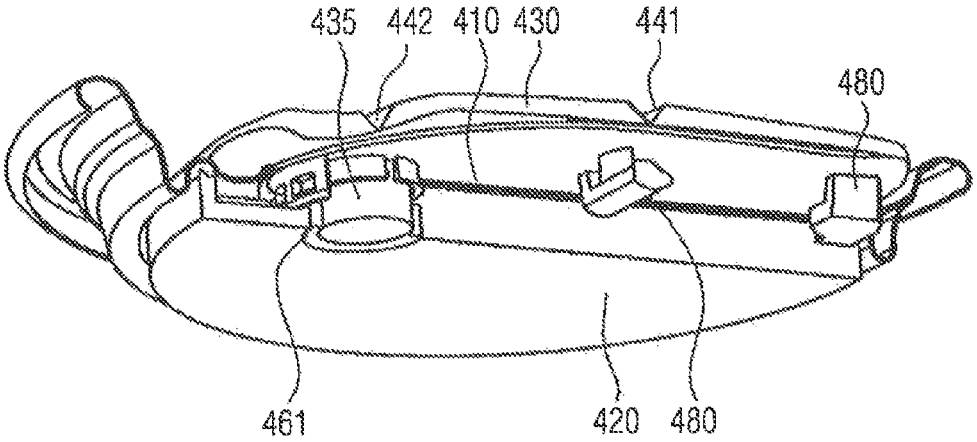
FIG. 4 shows a fourth embodiment of a lid according to the invention.

FIG. 4 shows a fourth embodiment. The elements comparable to FIG. 1 are provided with a reference numeral increased by the number 300.

In this fourth embodiment, the inner element 420 can be folded inwards to thereby release a pour opening (not shown). After unfolding the third portion 433 and the second portion 432 of the actuating element 430 said element can be shifted along the lid panel surface, whereby a folding away of the inner element 420 from the lid surface 410 is caused by way of slide noses 480 of the actuating element 430, said slide noses 480 running on inclined surfaces of the inner element 420. A sealing action of the inner element that is present in the closed state and acts against the lid surface is thereby reversed, and a fluid connection is established between interior and exterior.

Figure 5:
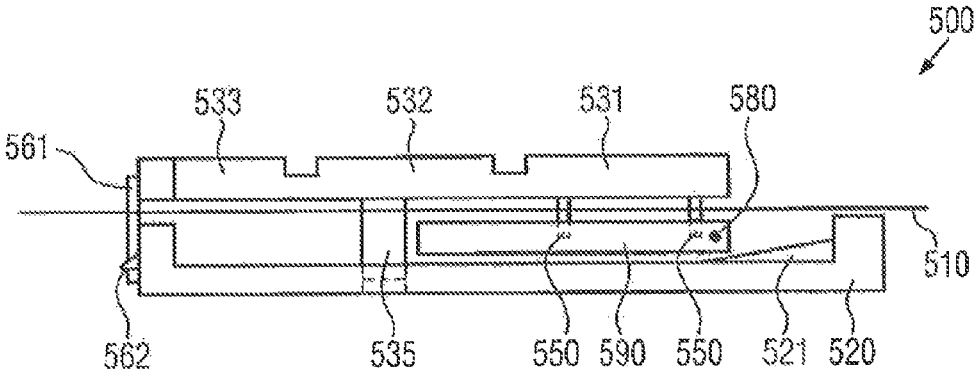
FIG. 5 shows a fifth embodiment of a lid according to the invention.

FIG. 5 shows a fifth embodiment. The elements comparable to FIG. 1 are provided with a reference numeral increased by the number 400.

In this fifth embodiment the actuating element 530 is connected in the area of the first portion 531 to an inner slide element 590, e.g. by way of riveting, which abuts on the inside of the lid surface 510. The connecting elements 550 (e.g. rivets) are movable in slit-shaped recesses of the lid surface 510, so that the unit consisting of actuating element 530 and inner slide element 590 can be shifted (after unfolding of the third and second portion of the actuating element) along the lid surface 510. The inner slide element 590 can moreover comprise slide noses 580 which upon shifting will abut onto inclined surfaces 521 of the inner element 520 and can fold away said element inwards, according to the mode of operation in the fourth embodiment with the slide noses 480 of the actuating element 430.

The invention claimed is:

1. A lid for a container, in particular for a can, comprising:

a lid surface with a first opening passing through the lid surface;

an inner element which is arranged on an inner side of the lid surface and has a ventilating opening which passes through the inner element and is aligned with the first opening;

an actuating element which is arranged on an outer side of the lid surface and is formed preferably from plastics material, wherein the actuating element has a first and a second articulation region, said regions subdividing the actuating element into a first, a second and a third portion, and the second portion is arranged between the first and the third portions; wherein the first portion of the actuating element is arranged in abutment against the lid surface;

the second portion of the actuating element can be pivoted relative to the first portion about the first articulation region and the second portion has a closing element, in particular a pin, for closing the ventilating opening;

the third portion of the actuating element can be pivoted relative to the second portion about the second articulation region and the third portion has a first coupling element; and the inner element has a second coupling element which can be coupled to the first coupling element.

2. The lid according to claim 1, wherein the first and second coupling elements provide a retention force in the coupled state upon exertion of a pressure on the closing element, starting from an interior of the container, particularly a retention force perpendicular to the lid surface that prevents the closing element from being pushed out of the ventilating opening.

3. The lid according to claim 1, wherein the first and the second coupling element are configured to be complementary to and engageable with each other.

4. The lid according to claim 1, wherein the first coupling element is configured as one or plural eyelets and the second coupling element as one or plural snap-in noses, or vice versa, and wherein respective snap-in noses are engageable with respective eyelets.

5. The lid according to claim 1, wherein the coupling between first and second coupling element is self-locking, particularly such that a compressive force on the closing element is transmitted to the first coupling element such that it acts against a decoupling direction of the coupling elements.

6. The lid according to claim 1, wherein the articulation regions are configured to be straight, particularly parallel to one another.

7. The lid according to claim 1, wherein the articulation regions are configured as regions of the actuating element with reduced material thickness, particularly as notches that are preferably provided at a side facing away from the lid surface.

8. The lid according to claim 7, wherein in the second articulation region one or plural struts are provided between the second and third portion, which, starting from a planar orientation of the second and third portion, allow pivotability into a first direction, particularly by compressibility or bendability of the struts, and aggravate pivotability into a second direction opposite to the first direction, particularly in that the force application is greater upon pivoting into the second direction in relation to the force application upon pivoting into the first direction.

9. The lid according to claim 8, wherein the first direction is oriented away from the lid surface, particularly wherein the first direction is an unfolding direction of the third portion upon opening of the container.

10. The lid according to claim 1, wherein the first and second coupling elements can be coupled with each other repeatedly one after the other and can be decoupled again and thereby provide reclosability of the ventilating opening.

11. The lid according to claim 1, wherein a second opening is provided in the lid surface and a fluid connection can be established between the second opening and a container interior by folding away the inner element from the inner side of the lid surface.

12. The lid according to claim 11, wherein the first portion of the actuating element is connected to or contactable with the inner element, particularly allowing a sliding movement relative to one another, and the inner element can be folded away by shifting the first portion of the actuating element.

13. The lid according to claim 11, further comprising an inner slide element which is arranged on the inner side of the lid surface, wherein the first portion of the actuating element is connected to the inner slide element, and a unit consisting of the first portion of the actuating element and the inner slide element is shiftable along the lid surface, wherein further the inner slide element is connected to or contactable with the inner element, particularly allowing a sliding movement relative to each other, and the inner element can be folded away by shifting the unit.

14. The lid according to claim 12, wherein a shifting of the first portion is only possible after an unfolding of the third portion and a subsequent unfolding of the second portion, particularly after the first and second coupling elements are decoupled thereby and the closing element is subsequently removed from the ventilating opening and the first opening.

15. A container, particularly a can, comprising:

a basic body; and a lid according to claim 1.

* * * * *